US012650087B1

(12) United States Patent
Dike

(10) Patent No.: US 12,650,087 B1
(45) Date of Patent: Jun. 9, 2026

(54) VARIABLE DURATION VALVE TRAIN

(71) Applicant: Anthony Dike, Ben Wheeler, TX (US)

(72) Inventor: Anthony Dike, Ben Wheeler, TX (US)

( * ) Notice: Subject to any disclaimer, the term of this patent is extended or adjusted under 35 U.S.C. 154(b) by 0 days.

(21) Appl. No.: 19/082,375

(22) Filed: Mar. 18, 2025

(51) Int. Cl.
*F01L 1/08* (2006.01)
*F01L 9/10* (2021.01)
*F01L 9/40* (2021.01)

(52) U.S. Cl.
CPC *F01L 1/08* (2013.01); *F01L 9/10* (2021.01); *F01L 9/40* (2021.01)

(58) Field of Classification Search
CPC ... F01L 1/08; F01L 1/181; F01L 1/047; F01L 1/18; F01L 1/053; F01L 1/02; F01L 9/10; F01L 9/11; F01L 9/40; F01L 13/0036; F01L 3/06; F01L 2305/00
See application file for complete search history.

(56) References Cited

U.S. PATENT DOCUMENTS 3,727,595 A * 4/1973 Links ..... F01L 9/10 123/90.15
4,408,580 A 10/1983 Kosuda
4,502,426 A 3/1985 Skelley
4,640,238 A 2/1987 Camosso
5,572,963 A 11/1996 Kawasaki
5,857,438 A 1/1999 Barnard
6,619,251 B2 9/2003 Kobayashi
7,077,088 B1 7/2006 Decuir, Jr.
D528,564 S 9/2006 Tomiji
8,127,727 B2 * 3/2012 Methley ..... F01L 13/0047 74/559
8,151,763 B2 * 4/2012 Meistrick ..... F01L 9/11 123/90.15
8,656,872 B1 2/2014 Dike
8,667,939 B2 * 3/2014 Barnes ..... F01L 13/0021 123/90.6
8,763,572 B1 7/2014 Dike
8,820,276 B2 * 9/2014 Vorih ..... F01L 13/0005 123/90.15
9,732,639 B1 8/2017 Dike
2006/0254545 A1 * 11/2006 Hirano ..... F01L 1/185 123/90.15
2020/0109648 A1 * 4/2020 Baltrucki ..... F01L 13/0005
2020/0291826 A1 * 9/2020 Mandell ..... F01L 13/06

* cited by examiner

*Primary Examiner* — Dapinder Singh
(74) *Attorney, Agent, or Firm* — Kyle A. Fletcher, Esq.

(57) ABSTRACT

The variable duration valve train controls the flow of air into the combustion chambers of the combustion engine. The variable duration valve train includes a drive cylinder structure, a stroke limit cylinder structure, an engine valve structure, a plurality of cams, and a working fluid. The engine valve structure attaches to the drive cylinder structure. The stroke limit cylinder structure forms a fluidic connection with the drive cylinder structure. The working fluid fills the stroke limit cylinder structure and the drive cylinder structure. The plurality of cams form mechanical linkages with the drive cylinder structure and the stroke limit cylinder structure. The working fluid and the plurality of cams limit the range of motion of the engine valve structure.

14 Claims, 4 Drawing Sheets

VARIABLE DURATION VALVE TRAIN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of methods for controlling delivery of fuel or combustion-air to a combustion engine. (F02D33/00)

SUMMARY OF INVENTION

The variable duration valve train controls the flow of air into the combustion chambers of the combustion engine. The variable duration valve train comprises a drive cylinder structure, a stroke limit cylinder structure, an engine valve structure, a plurality of cams, and a working fluid. The engine valve structure attaches to the drive cylinder structure. The stroke limit cylinder structure forms a fluidic connection with the drive cylinder structure. The working fluid fills the stroke limit cylinder structure and the drive cylinder structure. The plurality of cams form mechanical linkages with the drive cylinder structure and the stroke limit cylinder structure. The working fluid and the plurality of cams limit the range of motion of the engine valve structure.

These together with additional objects, features and advantages of the variable duration valve train will be readily apparent to those of ordinary skill in the art upon reading the following detailed description of the presently preferred, but nonetheless illustrative, embodiments when taken in conjunction with the accompanying drawings.

In this respect, before explaining the current embodiments of the variable duration valve train in detail, it is to be understood that the variable duration valve train is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the variable duration valve train.

It is therefore important that the claims be regarded as including such equivalent construction insofar as they do not depart from the spirit and scope of the variable duration valve train. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
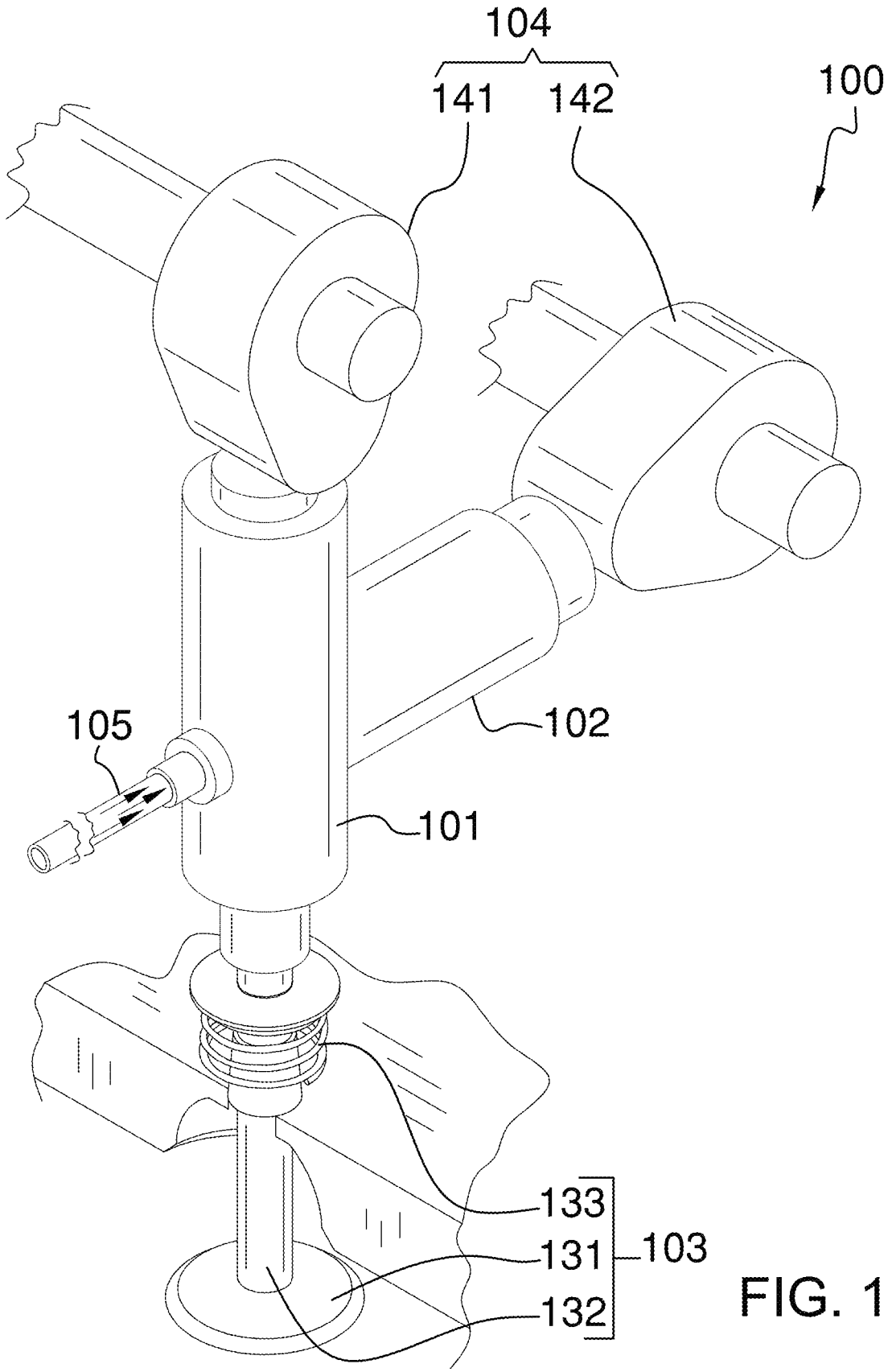
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 4.

The variable duration valve train 100 (hereinafter invention) controls the flow of air into the combustion chambers of the combustion engine. The invention 100 comprises a drive cylinder 111 structure 101, a stroke limit cylinder 121 structure 102, an engine valve structure 103, a plurality of cams 104, and a working fluid 105. The engine valve structure 103 attaches to the drive cylinder 111 structure 101. The stroke limit cylinder 121 structure 102 forms a fluidic connection with the drive cylinder 111 structure 101. The working fluid 105 fills the stroke limit cylinder 121 structure 102 and the drive cylinder 111 structure 101. The plurality of cams 104 form mechanical linkages with the drive cylinder 111 structure 101 and the stroke limit cylinder 121 structure 102. The working fluid 105 and the plurality of cams 104 limit the range of motion of the engine valve structure 103.

The engine valve structure 103 is a valve that controls the flow of gas through the internal combustion engine. The engine valve structure 103 physically attaches to the drive cylinder 111 structure 101 such that the drive cylinder 111 structure 101 controls the opening and closing of the engine valve structure 103. The engine valve structure 103 opens and closes over a stroke length. The drive cylinder 111 structure 101 controls the volume of gas flow through the engine valve structure 103 by controlling the stroke length over which the valve opens and closes. The drive cylinder 111 structure 101 controls the stroke length of the motion of the valve by controlling the net force presented to the engine valve structure 103. The engine valve structure 103 comprises an engine valve plate 131, an engine valve stem 132, and an engine valve spring 133.

The engine valve plate 131 is a disk shaped plate. The engine valve plate 131 encloses an intake aperture that permits the flow of a gas into (or out of) the internal combustion engine. The position of the engine valve plate 131 relative to the aperture controls the amount of gas that passes through the aperture. The invention 100 controls the position of the engine valve plate 131 relative to the intake aperture by controlling the stroke length of the engine valve stem 132.

The engine valve stem 132 is a mechanical structure that attaches the engine valve plate 131 to the valve piston 113 of the drive cylinder 111 structure 101 such that the motion of the drive piston 112 within the drive cylinder 111 moves the engine valve plate 131 relative to the intake aperture.

The engine valve spring 133 is a spring that attaches to the engine valve stem 132. The engine valve spring 133 is deformed as the engine valve stem 132 move the engine valve plate 131 away from the intake aperture. The engine valve spring 133 ensures that the engine valve plate 131 has the energy required to seat properly when the engine valve stem 132 returns the engine valve plate 131 to a closed position.

Each cam selected from the plurality of cams 104 is operated by the internal combustion engine. Each cam selected from the plurality of cams 104 performs a function selected from the group consisting of: a) generating a motive force that is transmitted to the engine valve structure 103 through the drive cylinder 111 structure 101; and, b) setting the stop position of the stroke limit piston 122 within the stroke limit cylinder 121 structure 102. The plurality of cams 104 comprises an engine cam 141 and a stroke limit cam 142.

The engine cam 141 is a rotating structure that is provided through the internal combustion engine. The engine cam 141 provides the motive forces that move the drive piston 112 within the drive cylinder 111.

The stroke limit cam 142 is a rotating structure that is provided through the internal combustion engine. The stroke limit cam 142 mechanically blocks the motion of the stroke limit piston 122 within the stroke limit cylinder 121. The rotation of the stroke limit cam 142 relative to the stroke limit piston 122 adjusts the stop position of the stroke limit piston 122.

The working fluid 105 is a fluid selected from the group consisting of: a) a gas phase fluid; b) a liquid phase fluid; and, c) a mixed phase (gas and liquid phases) fluid. The working fluid 105 is maintained under pressure in the combined negative space formed by the stroke limit cylinder 121 structure 102 and the drive cylinder 111 structure 101. The working fluid 105 creates the mechanical resistance presented to the engine cam 141 by the drive cylinder 111 structure 101. The working fluid 105 physically directly generates a portion of the mechanical resistance presented to the engine cam 141. The working fluid 105 further forms a buffer that redirects a portion of the energy generated by the engine cam 141 into the stroke limit cylinder 121 structure 102. The working fluid 105 comprises a working fluid 105 control valve 151.

The working fluid 105 control valve 151 is a valve structure that mounts in the working fluid 105 intake port 115. The working fluid 105 control valve 151 controls the flow of the working fluid 105 into the out of the combined negative space formed by the stroke limit cylinder 121 structure 102 and the drive cylinder 111 structure 101.

The drive cylinder 111 structure 101 forms a mechanical linkage between the plurality of cams 104 and the engine valve structure 103. The drive cylinder 111 structure 101 transfers a motive force received from the plurality of cams 104 to the engine valve structure 103. The motive force delivered by the drive cylinder 111 structure 101 to the engine valve structure 103 opens and closes the engine valve structure 103.

The drive cylinder 111 structure 101 presents a variable mechanical resistance to the plurality of cams 104. By mechanical resistance is meant that the drive cylinder 111 structure 101 presents a counterforce that must be overcome by the motive forces generated by the plurality of cams 104. By variable mechanical resistance is meant that the mechanical resistance presented by the drive cylinder 111 structure 101 is adjustable.

The stroke length of the engine valve structure 103 is determined by net force presented by the drive cylinder 111 structure 101. By net force is meant the difference between the motive force generated by the plurality of cams 104 to the drive cylinder 111 structure 101 and the counterforce presented to the generated force by the drive cylinder 111 structure 101. The stroke length of the drive cylinder 111 structure 101 adjusts by adjusting the mechanical resistance presented by the drive cylinder 111 structure 101 to the plurality of cams 104.

The drive cylinder 111 structure 101 comprises a drive cylinder 111, a drive piston 112, a valve piston 113, a drive cylinder 111 spring 114, a working fluid 105 intake port 115, and a stroke limit cylinder 121 port 116.

The drive cylinder 111 is a prism shaped negative space. The drive cylinder 111 is formed through the drive cylinder 111 structure 101. The drive cylinder 111 forms a portion of the combined negative space formed by the stroke limit cylinder 121 structure 102 and the drive cylinder 111 structure 101. The drive cylinder 111 contains a portion of the working fluid 105 contained within the combined negative space formed by the stroke limit cylinder 121 structure 102 and the drive cylinder 111 structure 101.

The drive piston 112 is a piston. The drive piston 112 inserts into the drive cylinder 111 to form a composite prism structure. The drive piston 112 moves freely within the drive cylinder 111. The drive piston 112 forms a fluid impermeable seal with the interior walls of the drive cylinder 111. The drive piston 112 mechanically attaches to the engine cam 141 of the plurality of cams 104. The rotation of the engine cam 141 moves the drive piston 112 within the drive cylinder 111 in a rhythmic pattern within the drive cylinder 111. The working fluid 105 contained in the drive cylinder 111 generates the mechanical resistance that opposes the motive forces generated by the engine cam 141. The drive piston 112 further comprises a drive piston 112 rod 161.

The drive piston 112 rod 161 is a cylindrical structure. The drive piston 112 rod 161 mounts on the congruent end of the drive piston 112 that is proximal to the valve piston 113. The drive piston 112 rod 161 attaches to the drive piston 112 to form a composite prism structure. The outer dimension of the drive piston 112 rod 161 is lesser than the outer dimension of the drive piston 112. The difference in the outer dimensions of the drive piston 112 rod 161 and the drive piston 112 ensures that a minimum volume of negative space is maintained between the drive piston 112 and the valve piston 113.

The valve piston 113 is a piston. The valve piston 113 inserts into the drive cylinder 111. The valve piston 113 moves freely within the drive cylinder 111. The valve piston 113 forms a fluid impermeable seal with the interior walls of the drive cylinder 111. The valve piston 113 mechanically interacts with the drive piston 112. The valve piston 113 mechanically attaches to the engine valve stem 132 of the engine valve structure 103. The motion of the drive piston 112 through the drive cylinder 111 transfers a portion of the mechanical energy generated by the engine cam 141 to the engine valve stem 132. Specifically, the motion of the drive piston 112 moves the valve piston 113 within the drive cylinder 111. The motion of the valve piston 113 moves the engine valve stem 132 which moves the engine valve plate 131 thereby adjusting the flow of fluid through the engine valve structure 103. The valve piston 113 further comprises a valve piston 113 rod 162.

The valve piston 113 rod 162 is a cylindrical structure. The valve piston 113 rod 162 mounts on the congruent end of the valve piston 113 that is proximal to the drive piston 112. The valve piston 113 rod 162 attaches to the valve piston 113 to form a composite prism structure. The outer dimension of the valve piston 113 rod 162 is lesser than the outer dimension of the valve piston 113. The difference in the outer dimensions of the valve piston 113 rod 162 and the valve piston 113 ensures that a minimum volume of negative space is maintained between the valve piston 113 and the drive piston 112.

The drive cylinder 111 spring 114 is a spring. The drive cylinder 111 spring 114 attaches the drive piston 112 rod 161 to the valve piston 113 rod 162. The drive cylinder 111 spring 114 forms a buffer that absorbs transient forces that could potentially misalign the relative positions of the valve piston 113 and the valve piston 113.

The working fluid 105 intake port 115 is a port formed through the lateral face of the negative space formed by the drive cylinder 111. The working fluid 105 intake port 115 receives the working fluid 105 into the drive cylinder 111. The working fluid 105 intake port 115 receives the working fluid 105 under pressure from an externally provided source.

The stroke limit cylinder 121 port 116 is the fluidic connection that links the drive cylinder 111 with the stroke limit cylinder 121 to form the combined negative space formed by the stroke limit cylinder 121 structure 102 and the drive cylinder 111 structure 101.

The stroke limit cylinder 121 structure 102 forms a mechanical linkage with the plurality of cams 104. The stroke limit cylinder 121 structure 102 forms a fluidic connection with the drive cylinder 111 structure 101. The stroke limit cylinder 121 structure 102 combines with the drive cylinder 111 structure 101 to form a combined negative space. The combined negative space formed by the stroke limit cylinder 121 structure 102 and the drive cylinder 111 structure 101 forms a containment structure used to store the working fluid 105. The volume of the negative space presented by the stroke limit cylinder 121 structure 102 to the drive cylinder 111 structure 101 is variable.

The volume of the negative space presented by the stroke limit cylinder 121 structure 102 is partially controlled by the plurality of cams 104. Specifically, the plurality of cams 104 forms a stop that limits the range of motion of a piston contained within the stroke limit cylinder 121 structure 102. The stroke limit cylinder 121 structure 102 forms a portion of the counterforce that opposes the energy transfer from the plurality of cams 104 to the engine valve structure 103. The amount of counterforce provided by the stroke limit cylinder 121 structure 102 is a function of the volume of the negative space presented to the drive cylinder 111 structure 101 by the stroke limit cylinder 121 structure 102.

The stroke limit cylinder 121 structure 102 comprises a stroke limit cylinder 121, a stroke limit piston 122, a buffer piston 123, and a stroke limit cylinder 121 spring 124.

The stroke limit cylinder 121 is a prism shaped negative space. The stroke limit cylinder 121 is formed through the stroke limit cylinder 121 structure 102. The stroke limit cylinder 121 forms a portion of the combined negative space formed by the stroke limit cylinder 121 structure 102 and the drive cylinder 111 structure 101. The stroke limit cylinder 121 contains a portion of the working fluid 105 contained within the combined negative space formed by the stroke limit cylinder 121 structure 102 and the drive cylinder 111 structure 101.

The stroke limit piston 122 is a piston. The stroke limit piston 122 inserts into the stroke limit cylinder 121 to form a composite prism structure. The stroke limit piston 122 moves freely within the stroke limit cylinder 121. The stroke limit piston 122 forms a fluid impermeable seal with the interior walls of the stroke limit cylinder 121. The stroke limit piston 122 mechanically attaches to the stroke limit cam 142 of the plurality of cams 104. The rotation of the stroke limit cam 142 moves the stroke limit piston 122 within the stroke limit cylinder 121. The stroke limit cam 142 forms a stop that limits the motion of the stroke limit piston 122 within the stroke limit cylinder 121. The stop formed by the stroke limit cam 142 maintains the stroke limit piston 122 in a fixed position within the stroke limit cylinder 121. The stroke limit piston 122 further comprises a stroke limit piston 122 rod 171.

The stroke limit piston 122 rod 171 is a cylindrical structure. The stroke limit piston 122 rod 171 mounts on the congruent end of the stroke limit piston 122 that is proximal to the buffer piston 123. The stroke limit piston 122 rod 171 attaches to the stroke limit piston 122 to form a composite prism structure. The outer dimension of the stroke limit piston 122 rod 171 is lesser than the outer dimension of the stroke limit piston 122. The difference in the outer dimensions of the stroke limit piston 122 rod 171 and the stroke limit piston 122 ensures that a minimum volume of negative space is maintained between the stroke limit piston 122 and the buffer piston 123.

The buffer piston 123 is a piston. The buffer piston 123 inserts into the stroke limit cylinder 121. The buffer piston 123 moves freely within the stroke limit cylinder 121. The buffer piston 123 mechanically interacts with the stroke limit piston 122. The buffer piston 123 mechanically interacts with the working fluid 105 in the combined negative space formed by the stroke limit cylinder 121 structure 102 and the drive cylinder 111 structure 101.

The motion of the drive piston 112 through the drive cylinder 111 applies a force against the working fluid 105 that increases the pressure of the working fluid 105 against a congruent end of the buffer piston 123. The increased pressure against buffer piston 123 generates work that moves the buffer piston 123 within the stroke limit cylinder 121. The work generated by the pressure increase in the working fluid 105 to move the buffer piston 123 further increases the mechanical resistance presented by the drive cylinder 111 structure 101 motive forces generated by the engine cam 141. The stroke limit cam 142 adjusts the presented mechanical resistance by changing the stop position of the stroke limit piston 122 within the stroke limit cylinder 121.

The position of the stroke limit piston 122 within the stroke limit cylinder 121 limits the range of motion of the buffer piston 123 within the stroke limit cylinder 121. The limit of the motion of the buffer piston 123 limits the amount of work that can be diverted from the drive piston 112 into the buffer piston 123 which further controls the mechanical resistance presented by the working fluid 105. The buffer piston 123 further comprises a buffer piston 123 rod 172.

The buffer piston 123 rod 172 is a cylindrical structure. The buffer piston 123 rod 172 mounts on the congruent end of the buffer piston 123 that is proximal to the stroke limit piston 122. The buffer piston 123 rod 172 attaches to the buffer piston 123 to form a composite prism structure. The outer dimension of the buffer piston 123 rod 172 is lesser than the outer dimension of the buffer piston 123. The difference in the outer dimensions of the buffer piston 123 rod 172 and the buffer piston 123 ensures that a minimum volume of negative space is maintained between the buffer piston 123 and the stroke limit piston 122.

The stroke limit cylinder 121 spring 124 is a spring. The stroke limit cylinder 121 spring 124 attaches the stroke limit piston 122 rod 171 to the buffer piston 123 rod 172. The stroke limit cylinder 121 spring 124 forms a buffer that absorbs transient forces that could potentially misalign the relative positions of the buffer piston 123 and the buffer piston 123.

Figure 2:
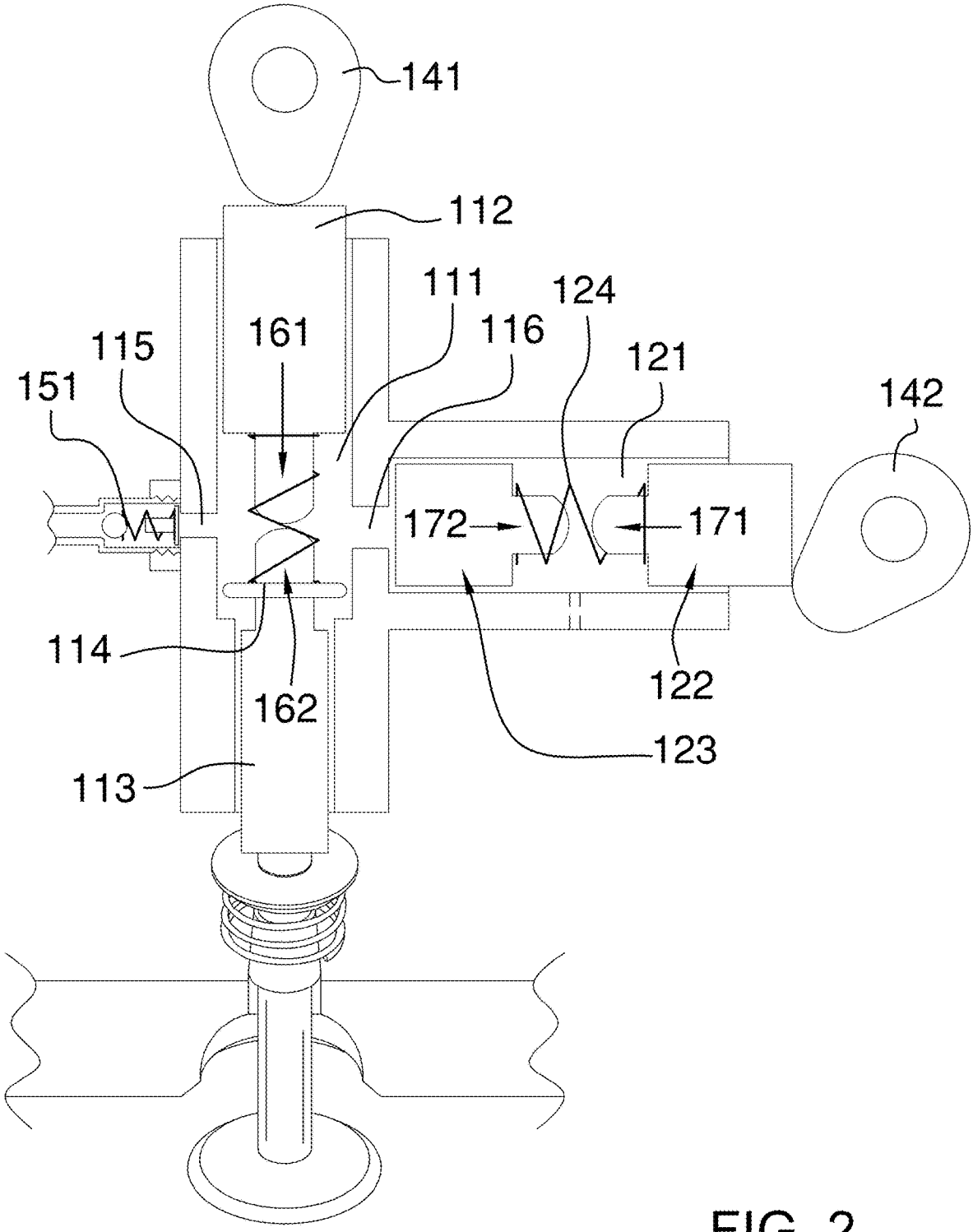
FIG. 2 is a view of an embodiment of the disclosure.

Referring to FIG. 2, the invention 100 is set at a start condition. When this occurs, the engine cam 141 pushes down the drive piston 112. Being that the drive cylinder 111 structure 101 is empty of fluid, the drive piston 112 continues downward until contact is made from the drive piston 112 rod 161 to the valve piston 113 rod 162 make contact with one another. The distance between the drive piston 112 rod 161 and the valve piston 113 rod 162 is designed to make contact, giving the engine cam 141 a duration of 220 degrees at 50, which is excellent for low RPMs of the engine. The actual duration of the engine cam 141 is 280 degrees duration at 50, which is good only at 5,000 rpms and up. As the engine cam 141 starts its downward motion, duration and lift are robbed off the lobe until contact is made. Final duration is decided by the distance between the drive piston 112 rod 161 and the valve piston 113 rod 162.

Figure 3:
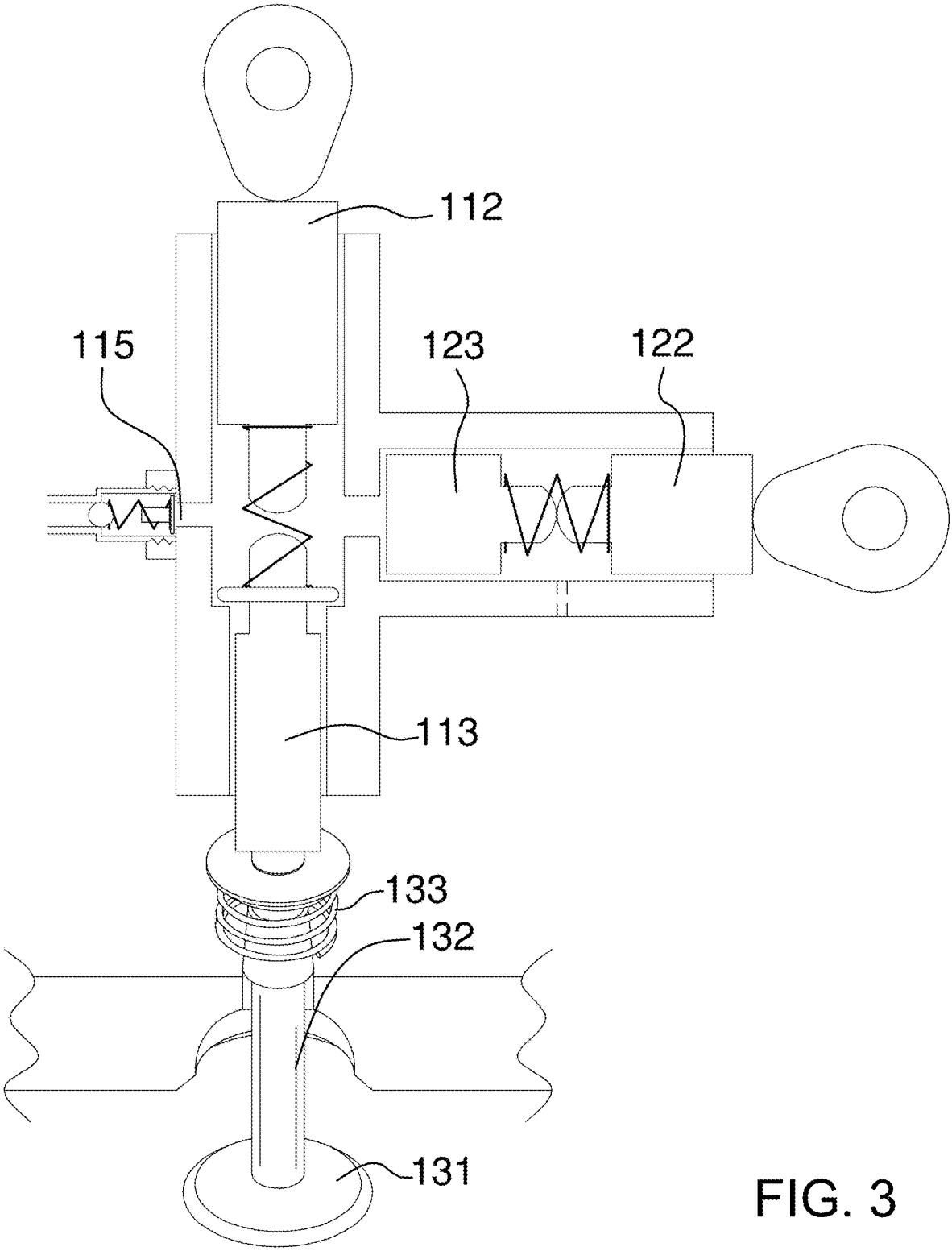
FIG. 3 is a view of an embodiment of the disclosure.
Figure 4:
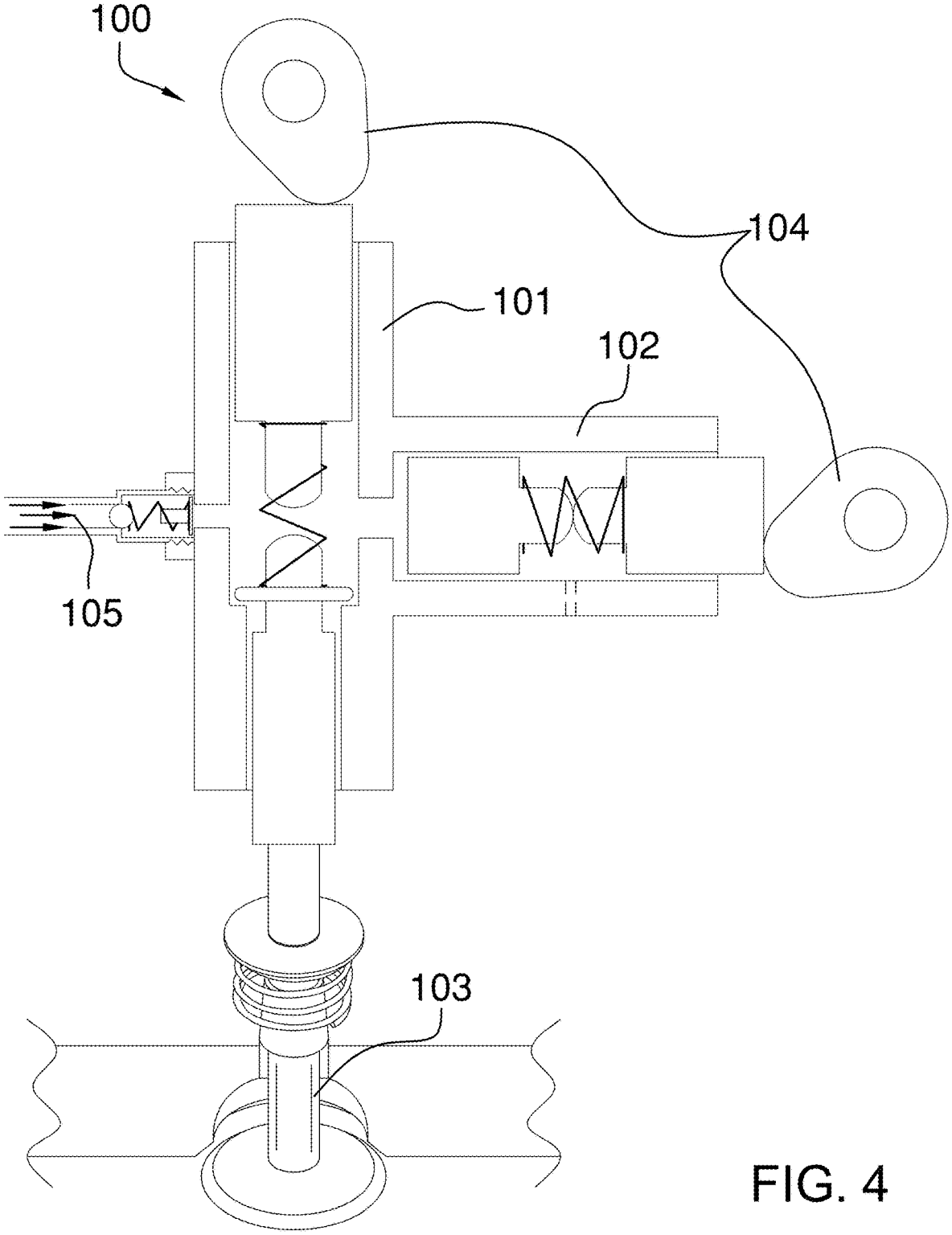
FIG. 4 is a view of an embodiment of the disclosure.

Referring to FIGS. 2-4, the drive cylinder 111 structure 101 is now filled with oil, which may be at 20 PSI. The engine cam 141 starts its downward stroke, the drive piston 112 builds pressure in the drive cylinder 111. When this occurs, the buffer piston 123 requires less pressure to move than the valve piston 113, therefore the buffer piston 123 moves first. The minimum valve opening is attained by letting the buffer piston 123 travel further. When this occurs, there are 3 benefits: a) less lift, b) less duration, and c) less spring pressure. Less lift means less spring pressure, which reduces horsepower from the crankshaft of the engine. Conversely, less duration provides more torque at lower engine RPM. The stroke limiter cam 142 determines the distance that the buffer piston 123 travels. This is accomplished by simply rotating the stroke limiter cam 142 to a desired position and leaving it there until another position is needed.

A maximum opening is achieved by lessening distance between the buffer piston 123 and the stroke limiter cam 142. If charge pressure is too high, it will override the stroke limit cylinder 121 spring 124, thereby causing the buffer piston 123 to progress forward, nulling out the variable operation of the system.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Ball: As used in this disclosure, a ball refers to an object with a spherical or nearly spherical shape.

Ball Check Valve: As used in this disclosure, a ball check valve is a type of check valve. A ball check valve is a valve that has a ball inserted into it such that the ball moves freely within the valve structure. The flow of fluid applies a force to the ball check valve that provides the motive forces that move the ball within the valve structure. The ball check valve is structured such that the flow of a fluid through the ball check valve in a first direction presses the ball into the flow path of the fluid through the ball check valve such that the fluid will apply a pressure against the ball that closes the fluid flow path through the ball check valve in the first direction. The ball check valve is further structured such that the flow of a fluid through the ball check valve in a second direction pushes the ball out of the flow path of the ball check valve such that the ball check valve allows the flow of fluid in the second direction. The second direction is the opposite direction to the first direction.

Buffer: As used in this disclosure, a buffer is an intermediate structure that connects a first device or structure to a second device or structure. The buffer is a compensating device that adjusts the operation of the second device in response to a change in the operation of the first device.

Cam: As used in this disclosure, a cam is a mechanical device that converts: 1) a rotating motion into a linear motion; or, 2) a linear motion into a rotating motion.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Check Valve: As used in this disclosure, a check valve is a valve that permits the flow of fluid in a single direction. Within selected potential embodiments of this disclosure, the check valve is a commercially available product that is selected from the group consisting of a ball check valve, a Tesla valve, and a duck valve.

Combustion engine: As used in this disclosure, a combustion engine is an engine powered by burning fuel within the engine. A common example of a combustion engine would be an engine designed with one or more cylinders formed as negative spaces. The combustion takes place within each cylinder to move a piston mounted within the cylinder.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Compress: In this disclosure, compress means to apply a forces to force a fixed mass of material into a smaller volume of space.

Compression Spring: As used in this disclosure, a compression spring is a spring that resists forces attempting to compress the spring in the direction of the center axis of the spring. The compression spring will return to its relaxed shape when the compressive force is removed.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Diametrically Opposed: As used in this disclosure, diametrically opposed is a term that describes the locations of a first object and a second object located at opposite ends of a diameter drawn through a third object. The term diametric opposition can also be used to describe this relationship.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Exterior: As used in this disclosure, the exterior is used as a relational term that implies that an object is not contained within the boundary of a structure or a space.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use fluidic connections are well-known and documented in the mechanical, chemical, and plumbing arts.

Force: As used in this disclosure, a force refers to a net (or unopposed) measurable interaction that changes the direction of motion of an object, the velocity of motion of an object, the momentum of an object, or the stress within an object. The term work refers to a measure of the amount of energy that is transferred through the application of a force over a distance. The term power refers to a measure of the amount of energy that is transferred over a period of time. See Energy Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior: As used in this disclosure, the interior is used as a relational term that implies that an object is contained within the boundary of a structure or a space.

Liquid: As used in this disclosure, a liquid refers to a state (phase) of matter that is fluid and that maintains, for a given pressure, a fixed volume that is independent of the volume of the container.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Mechanical Linkage: As used in this disclosure, a mechanical linkage is an interconnected arrangement of components that are used to manage the transfer of a movement or a force. A mechanical linkage is often referred to as a linkage.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Phase Change Terminology: As used in this disclosure, the following terms are used to describe a phase change. A phase change from a solid phase to a liquid phase is called melting. A phase change from a liquid phase to a solid phase is called freezing or solidification. A phase change from a solid phase to a gas phase is called sublimation. A phase change from a gas phase to a solid phase is called deposition. A phase change from a liquid phase to a gas phase is called evaporation. A phase change from a gas phase to a liquid phase is called condensation. A phase change from a gas phase to a plasma phase is called ionization. A phase change from a plasma phase to a gas phase is called recombination.

Piston: As used in this disclosure, a piston is a prism or disk that closely fits within a pipe or tube and that moves along the center axis of the pipe or tube. Depending on the context, a piston can also refer to the apparatus associated with the disk that allows the disk to move within the pipe or tube.

Plasma: As used in this disclosure, plasma refers to a state (phase) of matter wherein the outer valence electrons of an atom (or molecule) have been separated from their nucleus but remain with the matter. A plasma is an electrically neutral state of matter that is formed from the ions of the separated atoms. Plasmas generally, but not necessarily behaves like a gas in that a plasma fills the volume of the structure that contains it. The flow of a plasma through the atmosphere is called an arc. An arc is generally created when the atmosphere is subjected to an electric field that ionizes the molecules forming the atmosphere.

Pressure: As used in this disclosure, pressure refers to a measure of force per unit area.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Semi-Enclosed Prism: As used in this disclosure, a semi-enclosed prism is a prism-shaped structure wherein a portion of the lateral face of the prism-shaped is removed or otherwise replaced with a negative space. Always use negative space.

Solid: As used in this disclosure, a solid refers to a state (phase) of matter that: 1) has a fixed volume; and, 2) does not flow.

Stop: As used in this disclosure, a stop is a mechanical structure that blocks the motion of an object along a track. The stop is used to limit the range of motion of the object. The stop can also be configured apply a force that can be used to push an object along a track.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A variable duration valve train comprising a drive cylinder structure, a stroke limit cylinder structure, an engine valve structure, a plurality of cams, and a working fluid;

wherein the engine valve structure attaches to the drive cylinder structure;

wherein the stroke limit cylinder structure forms a fluidic connection with the drive cylinder structure;

wherein the working fluid fills the stroke limit cylinder structure and the drive cylinder structure;

wherein the plurality of cams form mechanical linkages with the drive cylinder structure and the stroke limit cylinder structure.

2. The variable duration valve train according to claim 1 wherein the variable duration valve train controls the operation of the engine valve structure;

wherein the engine valve structure is a valve that controls the flow of a gas;

wherein the working fluid and the plurality of cams limit the range of motion of the engine valve structure.

3. The variable duration valve train according to claim 2 wherein the engine valve structure physically attaches to the drive cylinder structure such that the drive cylinder structure controls the opening and closing of the engine valve structure;

wherein the engine valve structure opens and closes over a stroke length;

wherein the drive cylinder structure controls the volume of gas flow through the engine valve structure by controlling the stroke length over which the valve opens and closes;

wherein the drive cylinder structure controls the stroke length of the motion of the valve by controlling the net force presented to the engine valve structure.

4. The variable duration valve train according to claim 3 wherein each cam selected from the plurality of cams is externally operated;

wherein each cam selected from the plurality of cams performs a function selected from the group consisting of: a) generating a motive force that is transmitted to the engine valve structure through the drive cylinder structure; and, b) setting the stop position of the stroke limit piston within the stroke limit cylinder structure.

5. The variable duration valve train according to claim 4 wherein the engine valve structure comprises an engine valve plate, an engine valve stem, and an engine valve spring;

wherein the engine valve plate is a disk shaped plate;

wherein the variable duration valve train controls the position of the engine valve plate by controlling the stroke length of the engine valve stem;

wherein the engine valve stem is a mechanical structure that attaches the engine valve plate to the valve piston of the drive cylinder structure such that the motion of the drive piston within the drive cylinder moves the engine valve plate;

wherein the engine valve spring is a spring that attaches to the engine valve stem;

wherein the engine valve spring is deformed as the engine valve stem moves the engine valve plate.

6. The variable duration valve train according to claim 5 wherein the plurality of cams comprises an engine cam and a stroke limit cam;

wherein the engine cam is a rotating structure;

wherein the engine cam provides the motive forces that move the drive piston within the drive cylinder;

wherein the stroke limit cam is a rotating structure;

wherein the stroke limit cam mechanically blocks the motion of the stroke limit piston within the stroke limit cylinder;

wherein the rotation of the stroke limit cam relative to the stroke limit piston adjusts the stop position of the stroke limit piston.

7. The variable duration valve train according to claim 6 wherein the working fluid is a fluid selected from the group consisting of: a) a gas phase fluid; b) a liquid phase fluid; and, c) a mixed phase (gas and liquid phases) fluid;

wherein the working fluid is maintained under pressure in the combined negative space formed by the stroke limit cylinder structure and the drive cylinder structure;

wherein the working fluid creates the mechanical resistance presented to the engine cam by the drive cylinder structure;

wherein the working fluid physically directly generates a portion of the mechanical resistance presented to the engine cam;

wherein the working fluid further forms a buffer that redirects a portion of the energy generated by the engine cam into the stroke limit cylinder structure.

8. The variable duration valve train according to claim 7 wherein the drive cylinder structure forms a mechanical linkage between the plurality of cams and the engine valve structure;

wherein the drive cylinder structure transfers a motive force received from the plurality of cams to the engine valve structure;

wherein the motive force delivered by the drive cylinder structure to the engine valve structure opens and closes the engine valve structure;

wherein the drive cylinder structure presents a variable mechanical resistance to the plurality of cams;

wherein by mechanical resistance is meant that the drive cylinder structure presents a counterforce that must be overcome by the motive forces generated by the plurality of cams;

wherein by variable mechanical resistance is meant that the mechanical resistance presented by the drive cylinder structure is adjustable;

wherein the stroke length of the drive cylinder structure adjusts by adjusting the mechanical resistance presented by the drive cylinder structure to the plurality of cams.

9. The variable duration valve train according to claim 8 wherein the stroke limit cylinder structure forms a mechanical linkage with the plurality of cams;

wherein the stroke limit cylinder structure forms a fluidic connection with the drive cylinder structure;

wherein the stroke limit cylinder structure combines with the drive cylinder structure to form a combined negative space;

wherein the combined negative space formed by the stroke limit cylinder structure and the drive cylinder structure forms a containment structure used to store the working fluid;

wherein the volume of the negative space presented by the stroke limit cylinder structure to the drive cylinder structure is variable;

wherein the volume of the negative space presented by the stroke limit cylinder structure is partially controlled by the plurality of cams;

wherein the plurality of cams forms a stop that limits the range of motion of a piston contained within the stroke limit cylinder structure;

wherein the stroke limit cylinder structure forms a portion of the counterforce that opposes the energy transfer from the plurality of cams to the engine valve structure;

wherein the amount of counterforce provided by the stroke limit cylinder structure is a function of the volume of the negative space presented to the drive cylinder structure by the stroke limit cylinder structure.

10. The variable duration valve train according to claim 9 wherein the working fluid comprises a working fluid control valve;

wherein the working fluid control valve is a valve structure that mounts in the working fluid intake port;

wherein the working fluid control valve controls the flow of the working fluid into the out of the combined negative space formed by the stroke limit cylinder structure and the drive cylinder structure.

11. A variable duration valve train comprising a drive cylinder structure, a stroke limit cylinder structure, and an engine valve structure;

wherein the engine valve structure attaches to the drive cylinder structure;

wherein the stroke limit cylinder structure forms a fluidic connection with the drive cylinder structure.

12. The variable duration valve train according to claim 11 wherein the engine valve structure physically attaches to the drive cylinder structure such that the drive cylinder structure controls the opening and closing of the engine valve structure;

wherein the engine valve structure opens and closes over a stroke length;

wherein the drive cylinder structure controls the engine valve structure by controlling the stroke length over which the valve opens and closes;

wherein the drive cylinder structure controls the stroke length of the motion of the valve by controlling the net force presented to the engine valve structure.

13. The variable duration valve train according to claim 12 wherein the drive cylinder structure forms a mechanical linkage with the engine valve structure;

wherein the drive cylinder structure transfers a received motive force to the engine valve structure;

wherein the motive force delivered by the drive cylinder structure to the engine valve structure opens and closes the engine valve structure;

wherein the drive cylinder structure presents a variable mechanical resistance the received motive force;

wherein by mechanical resistance is meant that the drive cylinder structure presents a counterforce that must be overcome by the received motive force;

wherein by variable mechanical resistance is meant that the mechanical resistance presented by the drive cylinder structure is adjustable;

wherein the stroke length of the drive cylinder structure adjusts by adjusting the mechanical resistance presented by the drive cylinder structure to the plurality of cams.

14. The variable duration valve train according to claim 13 wherein the stroke limit cylinder structure forms a fluidic connection with the drive cylinder structure;

wherein the stroke limit cylinder structure combines with the drive cylinder structure to form a combined negative space;

wherein the combined negative space formed by the stroke limit cylinder structure and the drive cylinder structure forms a containment structure;

wherein the volume of the negative space presented by the stroke limit cylinder structure to the drive cylinder structure is variable;

wherein the stroke limit cylinder structure forms a portion of the counterforce that opposes the received motive force;

wherein the amount of counterforce provided by the stroke limit cylinder structure is a function of the volume of the negative space presented to the drive cylinder structure by the stroke limit cylinder structure.

* * * * *